US005377601A

United States Patent [19]

Cashen

[11] Patent Number: 5,377,601

[45] Date of Patent: Jan. 3, 1995

[54] TABLE WITH REMOVABLE LEGS

[75] Inventor: Richard E. Cashen, Mazon, Ill.

[73] Assignee: Suncast Corporation, Batavia, Ill.

[21] Appl. No.: 41,786

[22] Filed: Apr. 1, 1993

[51] Int. Cl.[6] ..... A47B 3/06

[52] U.S. Cl. ..... 108/157; 248/188.1

[58] Field of Search ..... 108/64, 65, 157, 159, 108/156, 158, 153; 240/188, 188.1

[56] References Cited

U.S. PATENT DOCUMENTS

| | | | |
|---|---|---|---|
| 2,568,538 | 9/1951 | Baker | 108/159 X |
| 2,937,062 | 5/1960 | Kruse | 108/157 X |
| 3,406,935 | 10/1968 | Mutchnik et al. | 108/157 X |
| 4,011,821 | 3/1977 | Neal | 108/156 |
| 4,052,837 | 8/1989 | Merten et al. | 108/156 X |
| 4,095,769 | 6/1978 | Fengels | 108/64 X |
| 4,740,033 | 4/1988 | Lee | 108/64 X |
| 4,848,245 | 7/1989 | Piretti | 108/156 |

FOREIGN PATENT DOCUMENTS

| | | | |
|---|---|---|---|
| 894101 | 4/1962 | United Kingdom | 108/64 |

*Primary Examiner*—Jose V. Chen

*Attorney, Agent, or Firm*—Fitch, Even, Tabin & Flannery

[57] ABSTRACT

A table, preferably of molded plastic construction, has a plug and socket engagement for securing legs to the table. Sockets formed in the table receive pentagonal plug portions of legs which are held in place by clamping members and threaded fasteners.

21 Claims, 5 Drawing Sheets

TABLE WITH REMOVABLE LEGS

BACKGROUND OF THE INVENTION

1. Field of the Invention

The present invention pertains to furniture having removable legs, and in particular to tables, support bases, shelf units and similar furniture which are assembled from a number of separate components without requiring special tools or assembly techniques.

2. Description of the Related Art

Over the years, various arrangements have been proposed to reduce the size of tables and other furniture, for easy storage and/or shipment to a remote location. For example, tables have been provided with folding legs to facilitate storage when not in use. Tables made of sheet metal components have been proposed in which the table is split into half portions which are hingedly connected together for even greater compaction. These types of tables are fully assembled at a factory location and are quickly erected by manipulating the hingedly interconnected components.

Certain advantages in economy of fabrication and shipment can be realized if the table can be formed from a number of separate, independent components assembled by an end user. Of course, it is important in the consumer market that the assembly required be relatively simple, without requiring special knowledge, assembly skills or tools. As those familiar with folding tables and the like are aware, it is especially important that the legs be securely attached to the table to prevent wiggling, leading to eventual separation from the table or collapse of the table structure.

SUMMARY OF THE INVENTION

It is an object according to principles of the present invention to provide tables, shelves and other furniture which are assembled from a number of separate, independent components.

Another object according to principles of the present invention is to provide a table of the above type with improved mounting of legs to a table.

A further object according to principles of the present invention is to provide a table of the above type in which the legs can be removed and easily stored with the table for subsequent use or shipment to a remote location.

Yet another object according to principles of the present invention is to provide a table of the above type having a table member which is formed by joining separate, independent table portions together.

These and other objects according to principles of the present invention are provided for an article of furniture having removable legs for resting on a support surface, with provision for mounting the legs in a working position and further provision for stowing the legs when not in use, the article of furniture comprising:

a generally planar body;

a plurality of elongated, double-ended legs having first ends for resting on the support surface and second ends engageable with the body to maintain the body at a preselected position away from the support surface;

leg mounting members carried on the body and engageable with the second ends of the legs so as to orient the legs in a working position, at an angle to the body;

the leg second ends and leg mounting members comprising telescopically interengaging plug and socket members;

said legs further having an outwardly protruding lip adjacent the second end, for engagement with a clamping member;

said body further having a first fastener engaging means adjacent the leg mounting members for engaging a fastener;

a clamping member engageable with the lip;

a fastener engageable with the clamping member and the first fastener engaging means to press the lip of the leg toward the leg mounting members to assist in maintaining engagement of the leg second ends and leg mounting members;

a bracket carried by the body extending at an angle to the body and defining a recess adjacent the body to at least partly receive a portion of a leg;

said body further having a second fastener engaging means adjacent the bracket for engaging the fastener; and the fastener engageable with the clamping member and the second fastener engaging means to press the portion of the leg toward the body to secure the leg in the bracket so as to store the leg along the body when not in use.

DETAILED DESCRIPTION OF THE PREFERRED EMBODIMENT

Figure 1:
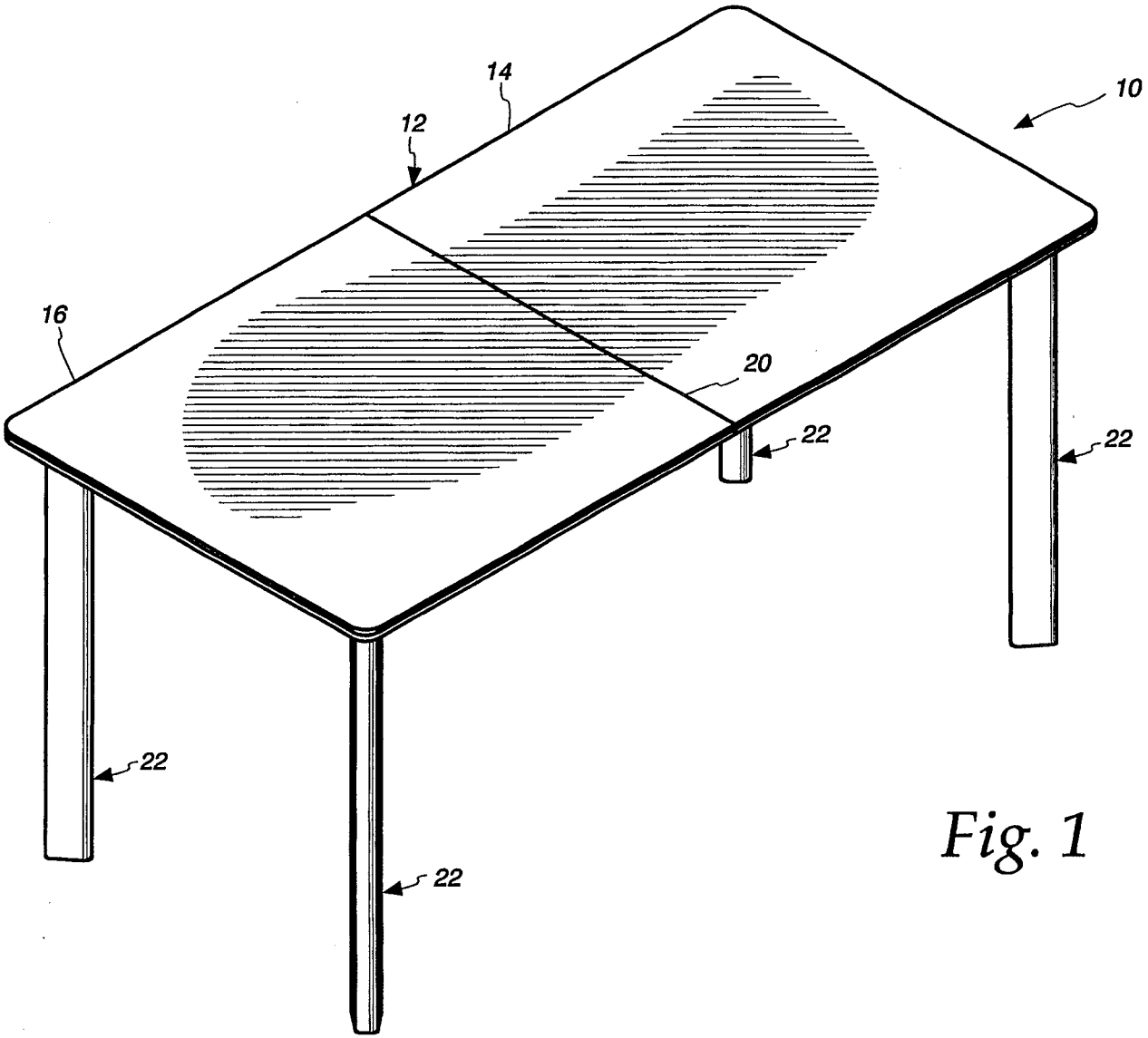
FIG. 1 is a perspective view of a table embodying principles according to the present invention.
Figure 2:
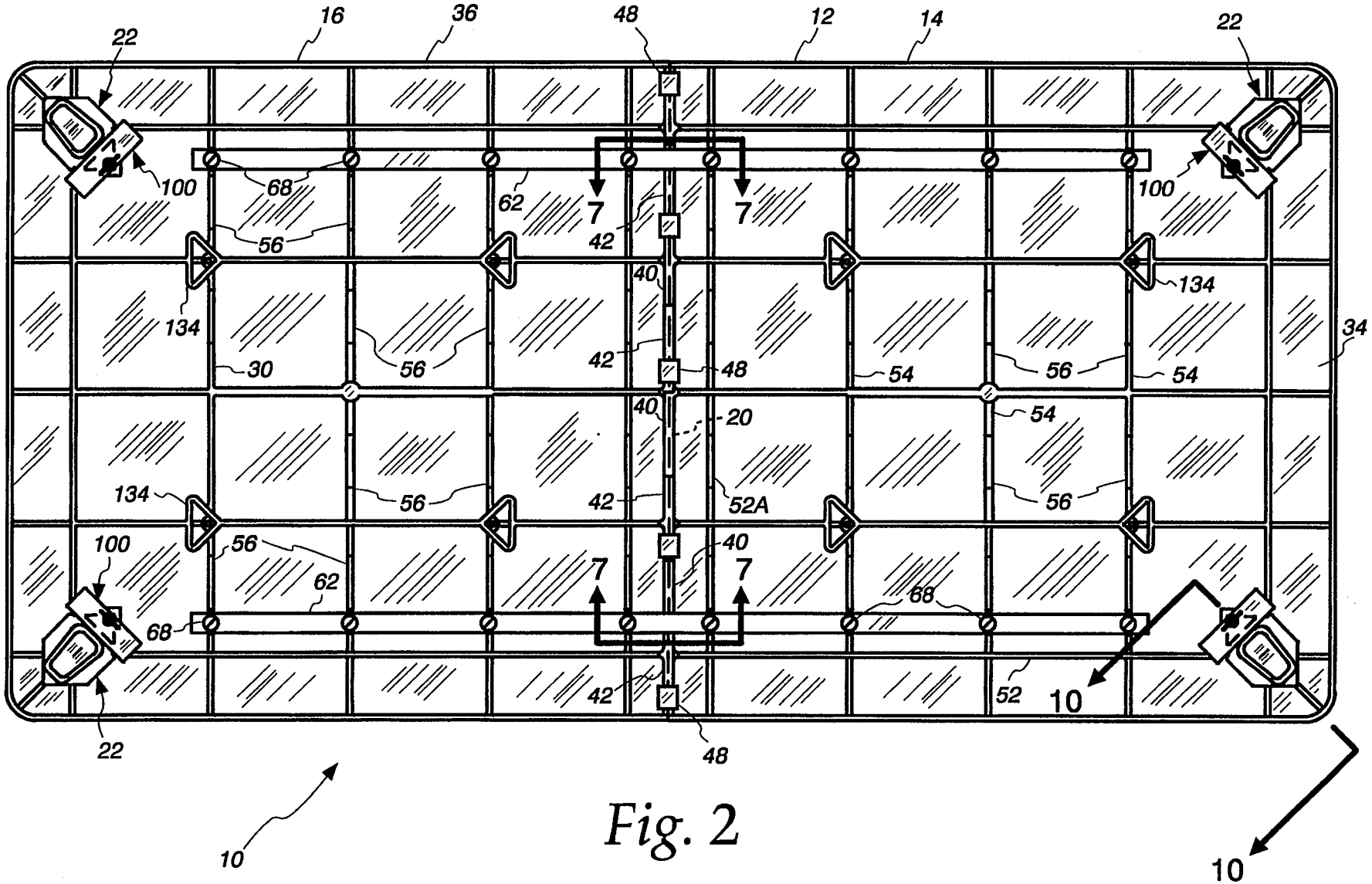
FIG. 2 is a bottom plan view thereof.

Referring now to the drawings, and initially to FIGS. 1 and 2, a table constructed according to principles of the present invention is generally indicated at 10. Table structure 10 includes a planar body portion or table assembly generally indicated at 12 comprising two table portions 14, 16 butted together along a joint line 20. The table assembly 12 is positioned above a floor or other support surface by a plurality of legs generally indicated at 22. In the preferred embodiment, four legs 22 support the table assembly 12 with the table assembly and supporting floor lying generally in parallel planes, and the table 10 comprising a self-supporting structure. Other arrangements according to the present invention are also possible, as will be seen herein. For example, table 10 could be divided along joint line 20, with the resulting exposed edge supported against a wall and, if desired, only a single leg need be employed to support the remaining cantilevered table portion. As will be seen herein, the present invention provides an improved easy assembly of furniture constructed according to principles of the present invention, while providing supporting legs having improved, superior strength and rigidity.

Turning now to FIG. 2, the table portions 14, 16 have a reinforcing gridwork 30 extending above generally sheet-like top walls 34, 36 of the table portions 14, 16, respectively. As can be seen in FIG. 2, each table portion 14, 16 has three free edges, the table portions being butted together at fourth edges. The table portion 14 has a series of spaced-apart upstanding joining tabs 40 interspersed with a spaced-apart series of upstanding joining tabs 42 of table portion 16. As can be seen in FIG. 2, the joining tabs 40, 42 are aligned as a serial array along joint line 20. The array is preferably continuous, but may have gaps between walls 40, 42, if desired.

Figure 7:
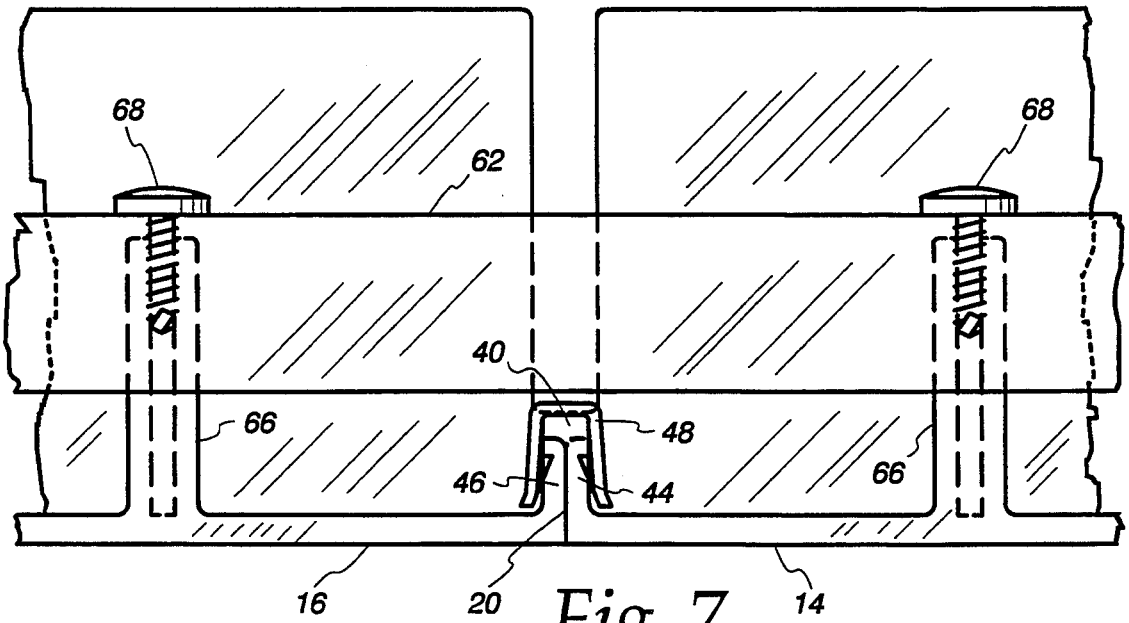
FIG. 7 is a fragmentary elevational view taken along the line 7—7 of FIG. 2, shown on an enlarged scale.

Referring now to FIG. 7, the joining tabs 40 are located at the upper free end of an edge wall 44 which is preferably continuous along the joint line 20. The table portion 16 has a similar continuous edge wall 46. As shown in FIG. 7, the joining tab 40 extends beyond wall 44, so as to overlie the upper end of edge wall 46. While the edge walls 44, 46 are continuous along joint line 20, the joining tabs 40, 42 are not. Accordingly, the spaced-apart series of joining tabs 40 provide a spaced series of recesses for receiving the joining tabs 42 of the mating table portion 16. In this manner, an interlocking engagement is provided along the entire length of joint line 20. If desired, the overlying joining walls can be shortened such that the interlocking joinder is not continuous along the joint line 20, although, as pointed out, such is not the case in the preferred embodiment. As can be seen from studying FIG. 2, the table portions 14, 16 are identically configured, which is preferred to simplify the molding process. However, the table portions 14, 16 need not be identical in order to maintain engagement of the edge walls 44, 46 along the joint line 20.

A series of clips 48 is provided along the joint line, as can be seen in FIG. 2. If desired, the clips could be extended in length so as to abut one another in a continuous array, and as a further alternative, a single clip 48 can be provided which extends along substantially the entire length of the joint line 20. The clips hold the abutting interlocking and overlapping tabs 40, 42 and walls 34, 36 in mating engagement with one another. The clips are preferably made of metal, but may be made of suitable plastic or other resilient material.

Figure 4:
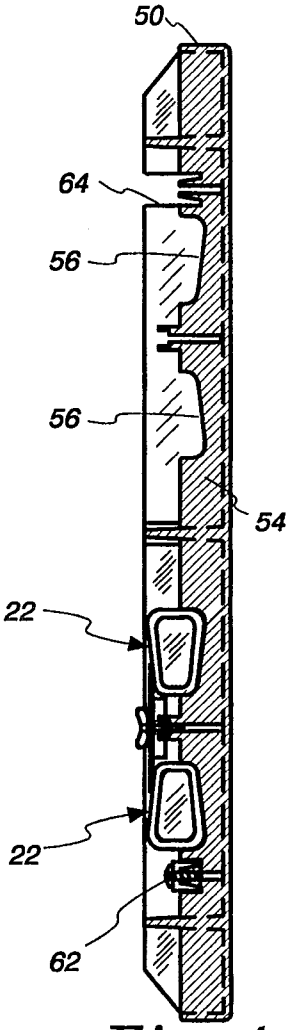
FIG. 4 is a cross-sectional view taken along the line 4—4 of FIG. 3.

Turning briefly to FIG. 4, it is readily apparent that the reinforcing gridwork 30 is comprised of walls of varying height to provide advantages, as will now be described. For example, with reference to FIG. 3, the outer border walls 50 at the outer periphery of the table portion and some of the internal walls 54 are of a reduced height. These outside peripheral walls are identified by the reference numeral 50. Preferably, a continuous wall 50 wraps around three sides of the table portion, with the aforementioned peripheral wall 44 providing the abutting joinder, as described above.

Located interior of the peripheral walls 40 are full height reinforcing walls 52, and reinforcing walls 54 of reduced height, preferably a height generally equal to the peripheral wall 50. In the preferred embodiment, three reduced height walls 54 are provided, and are shown as extending in generally vertical directions in FIG. 3. These reduced height walls have notched recesses 56 (which are aligned in generally horizontal directions in FIG. 3) so as to cooperate to receive a leg 22 for storage in the table portion. In the preferred embodiment, the table portions 14, 16 each define four series of recesses 56, and accordingly, each table portion can receive four legs therein. Two legs are shown stored in FIG. 3. As shown in FIG. 4, the recesses 56 have a shape complementing the cross-sectional shape of the legs 22, and preferably are configured so as to receive approximately one-half of the leg cross section. The leg cross section will be described below with reference to FIGS. 8 and 9.

Figure 3:
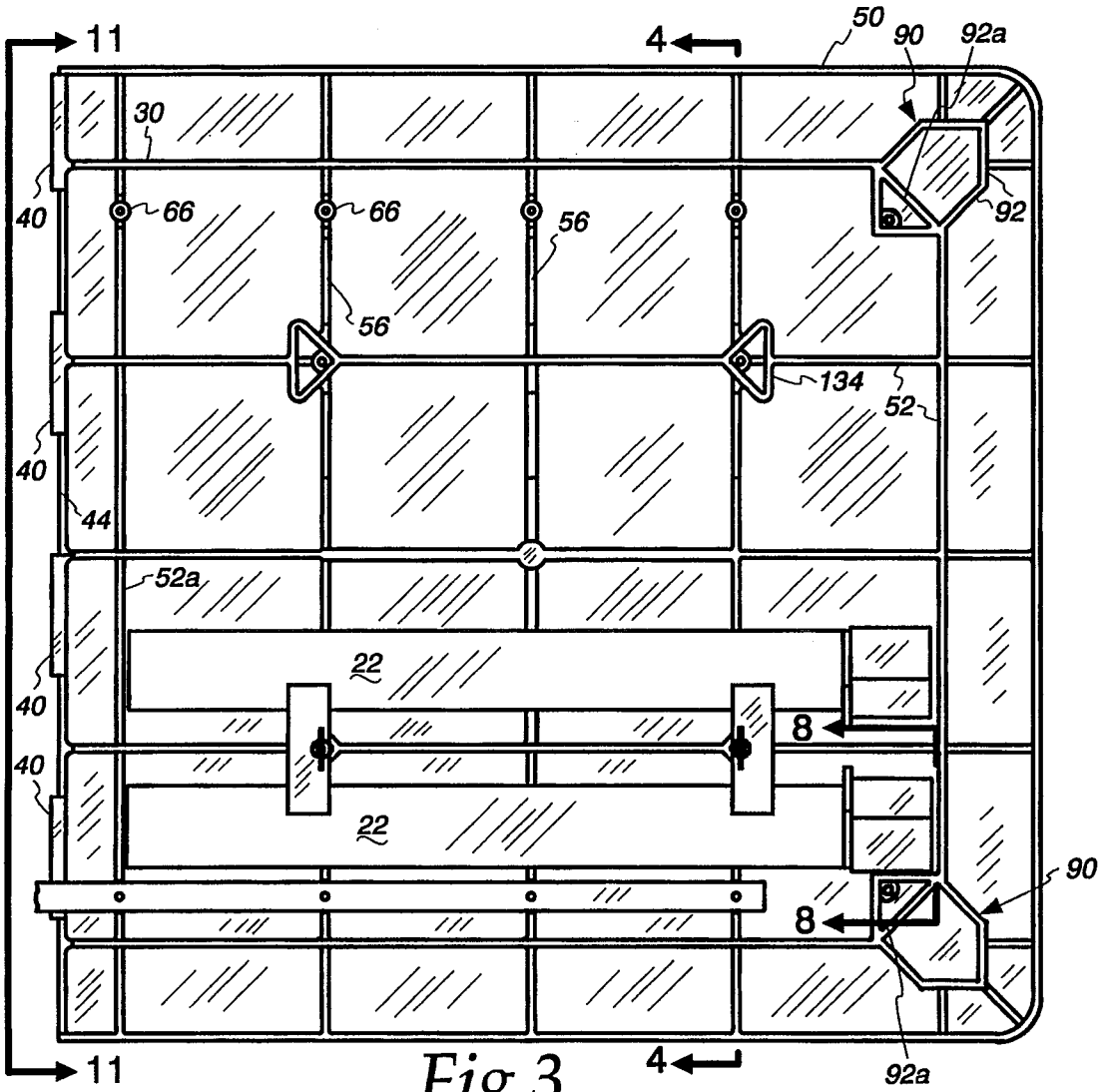
FIG. 3 shows the right hand portion of FIG. 2 on an enlarged scale.
Figure 11:
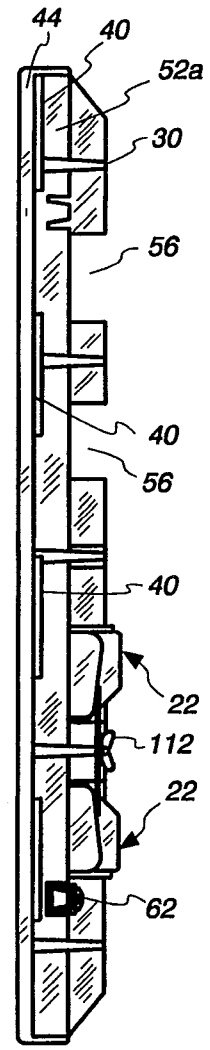
FIG. 11 is an end view of the table section of FIG. 3.
Figure 5:
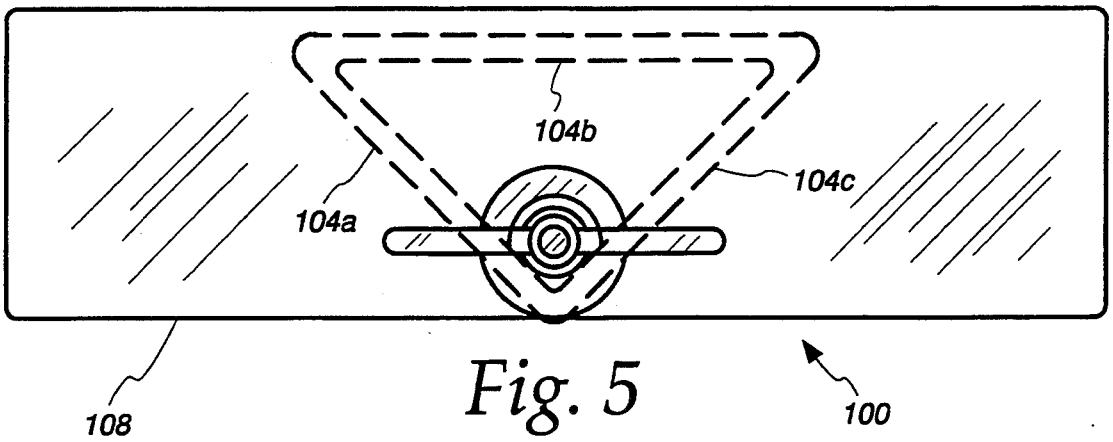
FIG. 5 is a top plan view of a clamping member.
Figure 6:
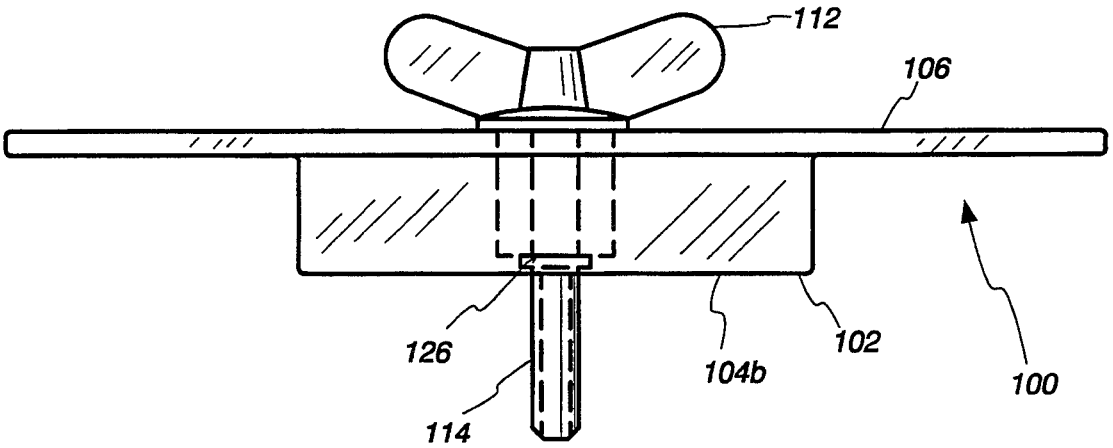
FIG. 6 is a front elevational view thereof.

Referring now to FIGS. 2 and 3, the table portions 14, 16 are joined together and supported by a pair of ribs 62 which preferably interlock with the reinforcing gridwork. As can be seen in FIG. 4, the reduced height walls 54 define recesses for receiving a reinforcing rib 62 which, as can be seen in FIG. 2, spans both table portions 14, 16. The ribs 62 are preferably of unitary construction, and are preferably made of stamped metal. The opposing full height walls **52*a* adjacent joint line 20 are notched at 64 so as to receive the ribs 62 (see FIG. 4). Generally cylindrical posts 66 are formed to received threaded fasteners 68, securing the ribs 62 in position. As can be seen in FIG. 4, the ribs 62** are of U-shaped channel construction and are received in the recesses with a snug fit.

Figure 8:
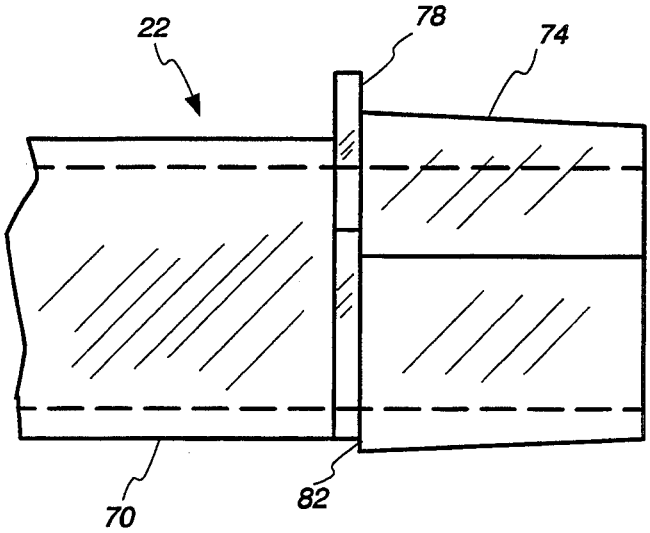
FIG. 8 is a side elevational view of a leg member.
Figure 9:
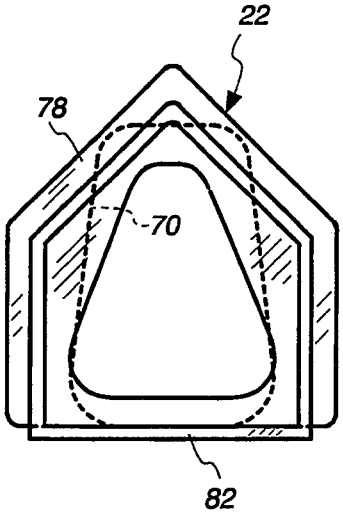
FIG. 9 is an end elevational view thereof.
Figure 10:
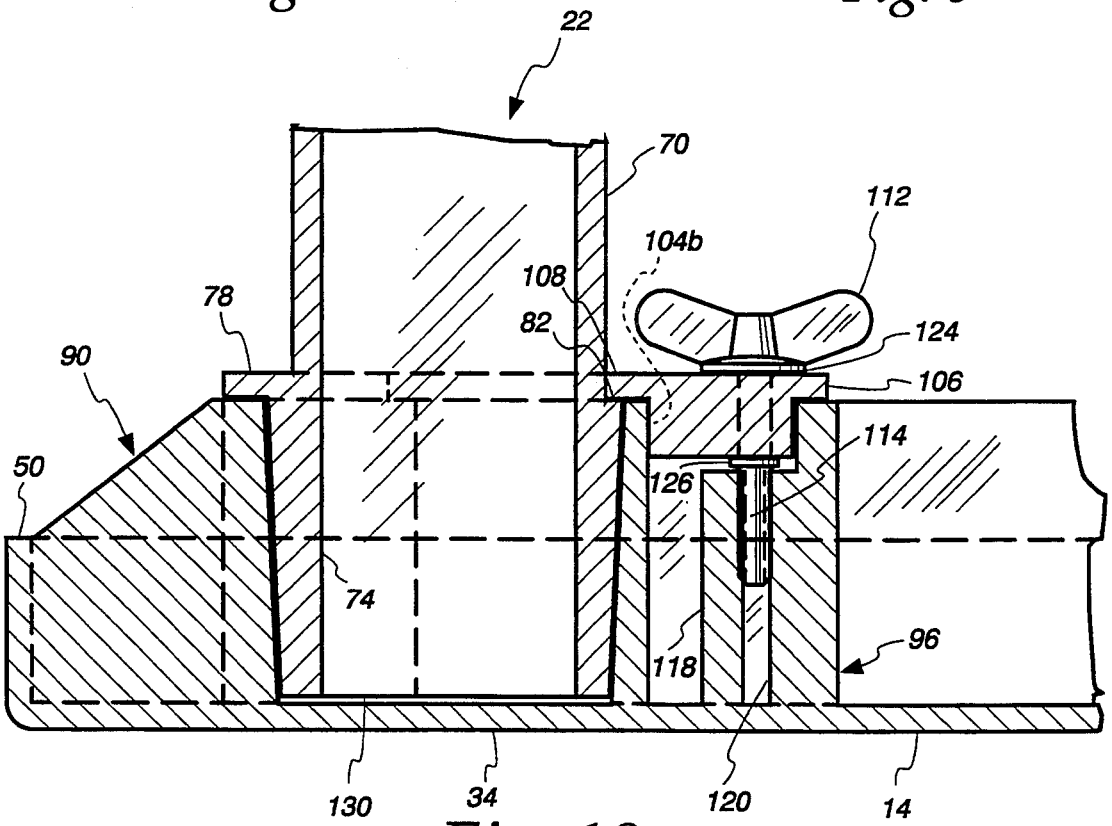
FIG. 10 is a fragmentary cross-sectional view taken along the line 10—10 of FIG. 2.

Turning now to FIGS. 8–10, the legs 22 have a generally tubular major body portion 70 with a generally trapezoidal cross section and rounded corners, as can be seen by the dot-dash line in FIG. 9. It is this portion of the leg which is visible in the cross-sectional view of FIG. 4, and to which the recesses 56 are preferably adapted. The leg 22 further includes an end portion preferably comprising a plug member for telescopic insertion within sockets formed in the table portions 14, 16. The plug end of tables 22 include an end portion having a polygonal, preferably pentagonal cross-sectional configuration, as shown in FIG. 9. Disposed between the body portion 70 and the pentagonal end portion 74 is an outwardly protruding lip 78 which extends along four of the five sidewall comprising end portion 74. At the fifth wall of end portion 74, the profile of the leg is stepped, as can be seen in FIG. 10, so as to form an exposed ledge 82.

Referring briefly to FIG. 3, and FIGS. 8–10 a pair of socket members 90 are formed in the table portion. The sockets 90 include a pentagonal cylinder having five planar wall portions 92. The sockets 90 may have other cylindrical shapes of multigon cross section, so as to complement legs having head portions of different shapes. The socket 90 could comprise a right circular cylinder, that is, a cylinder having a right circular cross section. However, it is preferable that the socket have a cylinder of multi-sided, preferably five-sided or pentagonal configuration. Accordingly, the cross section of the pentagonal cylinder of the preferred embodiment is that of a hollow pentagon. The socket sidewall **92*a* preferably points toward the interior of the table portion, and, as can be seen in FIG. 10, is positioned adjacent the ledge 82 of the leg. A locking socket member 96 is located immediately adjacent the socket member 90, and wall 92*a* is common between the socket menders 90, 96. In the preferred embodiment, the locking socket member 96 comprises a triangular cylinder, that is, a hollow cylinder having three sides, as can be seen for example in FIG. 3. If desired, the table could carry the plug members 74 and the legs could carry the socket members 22**.

Referring now to FIGS. 2–6, table 10 further includes four clamping members generally indicated at 100. The clamping members include a triangular plug portion 102 having three plug walls 104, dimensioned for telescopic insertion within the locking sockets 96. The clamping member 100 further includes a normal wall 106 which lies normal to each of the plug walls 104, and which extends beyond the plug portion, as can be seen for example in FIG. 5. Wall 106 extends beyond the plug walls 104*a*, 104*c*. Further, an edge portion 108 extends beyond plug wall 104*b*. With reference to FIG. 10, edge portion 108 is dimensioned so that, with the plug walls 104 received in socket member 96 (that is, with plug wall 104*b* abutting or closely spaced to wall 92*a*), edge portion 108 overlies the upper free end of wall 92*a* and also the ledge 82. As can be seen in FIG. 10, the edge portion 108 is preferably of approximately the same thickness as that of lip 78.

The clamp member 100 further includes a threaded fastener having a manually graspable head 112 and a threaded portion 114. With reference to FIG. 10, the socket member 96 further includes a fastener engaging means or recessed post 118 having an internal threaded bore 120. The threaded fastener preferably includes shoulders 124, 126 which hold captive the plug walls and wall 106 in a fixed position in clamping engagement with plug member 96. The plug wall 92*a* and the ledge 82 of leg 22 prevent overtightening or misalignment of the clamp plug and leg members. In the preferred embodiment, the post 118 may be recessed slightly away from shoulder 126 of the threaded fastener so as to ensure compressive engagement between wall 106 of the clamping member in intimate engagement with the ledge 82. The slight gap shown in FIG. 10 between the free end 130 of leg 22 and the top wall 34 is effectively eliminated. A small gap is shown in FIG. 10 for purposes of clarity in distinguishing between the table portion and features of the leg 22.

With reference to the lower portion of FIG. 3, the clamping members 100 serve a dual purpose in that they also secure the leg members 22 in a stowed position with respect to the table portion. As shown in FIG. 2, the clamping members 100 are dimensioned so as to simultaneously engage a pair of legs 22, securing the legs in the recesses 56. As shown, for example, in the bottom right corner of FIG. 2, the portions of clamping members 100 which engage the legs 22 in the stowed position of FIG. 3 also engage normally-oriented reinforcing walls 52. This action adds to the stability of the clamping member, as well as enhancing the locking of the leg members which, in cooperation with the socket members 90, have been found to provide adequate clamping force to withstand dislodging forces applied to the leg members 22. In particular, the clamping members 100 have been found to adequately support the leg members in their cantilevered positions and to withstand dislodging forces amplified by the relatively long moment arms of the leg members. Thus, triangular struts and other bracing between the leg members and the table portions are rendered unnecessary by clamping members and plug and socket arrangements provided by the present invention. As can be seen in FIGS. 2 and 3, socket members 134 (which are virtually identical to the socket members 96) are provided at the interior of the table portions. The socket members 134, as mentioned above, cooperate with the recesses 56 to hold the legs in a stowed position.

One advantage of tables constructed according to principles of the present invention is that virtually all of the components of the table can be fabricated by using plastic molding techniques. In the preferred embodiment, the only non-molded plastic members are made of metal, and comprise the ribs 62 and the threaded fasteners 68, all other members of the table being made of plastic material. Of course, if desired, other materials other than plastic may be employed and, if desired, need not be made using molding techniques.

As will be appreciated by those skilled in the art, the construction described above, with proper dimensioning, can be immediately applied to support bases, shelf units, and similar items of furniture.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

I claim:

1. An article of furniture having removable legs for resting on a support surface, with provision for mounting the legs in a working position and further provision for stowing the legs when not in use, the article of furniture comprising:

a generally planar body;

a plurality of elongated, double-ended legs having first ends for resting on the support surface and second ends for engaging the body to maintain the body at a preselected position away from the support surface;

leg mounting members carried on the body for engaging the second ends of the legs so as to orient the legs in a working position, at an angle to the body;

the leg second ends and leg mounting members comprising telescopically interengaging plug and socket members;

said legs further having an outwardly protruding lip adjacent the second end, for engagement with a clamping member;

said body further having a first fastener engaging means adjacent the leg mounting members for engaging a fastener;

a clamping member engageable with the lip;

a fastener for engaging the clamping member and the first fastener engaging means so as to press the clamping member against the lip of the leg to assist in maintaining engagement of the leg second ends and leg mounting members;

a bracket carried by the body extending at an angle to the body and defining a recess adjacent the body to at least partly receive a portion of a leg;

said body further having a second fastener engaging means adjacent the bracket for engaging the fastener; and the fastener adapted to also engage the clamping member and the second fastener engaging means to press a portion of the leg toward the body to secure the leg in the bracket so as to store the leg along the body when not in use.

2. The article of furniture of claim 1 wherein said leg second ends comprise plug members fitting within said leg mounting members.

3. The article of furniture of claim 2 wherein said plug members have a multigon cross-section with a plurality of planar walls.

4. The article of furniture of claim 3 wherein said plug members have five walls.

5. The article of furniture of claim 1 wherein said clamping member is generally planar.

6. The article of furniture of claim 5 wherein said clamping member has a generally rectangular outer periphery.

7. The article of furniture of claim 6 wherein said leg mounting members have five walls.

8. The article of furniture of claim 1 wherein said leg mounting members comprises socket members having a part multigon cross-section with a plurality of planar walls.

9. The article of furniture of claim 8 wherein said first fastener engaging men, her comprises a post adjacent said socket members and defining a threaded recess.

10. The article of furniture of claim 8 wherein said second fastener engaging member comprises a post adjacent the bracket and defining a threaded recess.

11. The article of furniture of claim 1 wherein said fastener comprises a threaded screw member.

12. An article of furniture having removable legs for resting on a support surface with provision for stowing the legs when not in use, comprising:

a generally planar body;

a plurality of elongated, double-ended legs having first ends for resting on the support surface and second ends for engaging the body to maintain the body at a preselected position away from the support surface;

leg mounting members carried on the body and for engaging the second ends of the legs so as to orient the legs in a working position, at an angle to the body;

the leg second ends and leg mounting members comprising telescopically interengaging plug and socket members;

said legs further having an outwardly protruding lip adjacent the second end, for engagement with a clamping member;

said body further having a fastener engaging means adjacent the leg mounting members for engaging a fastener;

a clamping member engageable with the lip; and a fastener for engaging the clamping member and the fastener engaging means so as to press the clamping member against the lip of the leg to assist in maintaining engagement of the leg second ends and leg mounting members.

13. The article of furniture of claim 12 wherein said leg second ends comprise plug members fitting within said leg mounting members.

14. The article of furniture of claim 13 wherein said plug members have a multigon cross-section with a plurality of planar walls.

15. The article of furniture of claim 14 wherein said plug members have 5 walls.

16. The article of furniture of claim 12 wherein said clamping member is generally planar.

17. The article of furniture of claim 16 wherein said clamping member has a generally rectangular outer periphery.

18. The article of furniture of claim 12 wherein said fastener comprises a threaded screw member.

19. The article of furniture of claim 12 wherein said leg mounting members comprises socket members having a multigon cross-section with a plurality of planar walls.

20. The article of furniture of claim 19 wherein said leg mounting members have 5 walls.

21. The article of furniture of claim 19 wherein said first fastener engaging member comprises a post adjacent said socket members and defining a threaded recess.

* * * * *

UNITED STATES PATENT AND TRADEMARK OFFICE

CERTIFICATE OF CORRECTION

PATENT NO. : 5,377,601

DATED : January 3, 1995

INVENTOR(S) : Cashen

It is certified that error appears in the above-indentified patent and that said Letters Patent is hereby corrected as shown below:

Column 7, line 15, change "mem, her" to --member--.

Signed and Sealed this

Second Day of May, 1995

Bruce Lehman

*Attest:*

BRUCE LEHMAN

*Attesting Officer*

*Commissioner of Patents and Trademarks*